US008904812B2

(12) United States Patent
Yamashita et al.

(10) Patent No.: US 8,904,812 B2
(45) Date of Patent: Dec. 9, 2014

(54) REFRIGERATION CYCLE APPARATUS

(75) Inventors: Koji Yamashita, Tokyo (JP); Hiroyuki Morimoto, Tokyo (JP); Takeshi Hatomura, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 166 days.

(21) Appl. No.: 13/522,072

(22) PCT Filed: Feb. 10, 2010

(86) PCT No.: PCT/JP2010/000838
§ 371 (c)(1),
(2), (4) Date: Jul. 13, 2012

(87) PCT Pub. No.: WO2011/099067
PCT Pub. Date: Aug. 18, 2011

(65) Prior Publication Data
US 2013/0061623 A1 Mar. 14, 2013

(51) Int. Cl.

| | |
|---|---|
| ***F25B 31/00*** | (2006.01) |
| ***F25B 13/00*** | (2006.01) |
| ***F25B 41/00*** | (2006.01) |
| *F25B 25/00* | (2006.01) |

(52) U.S. Cl.
CPC ..... *F25B 13/00* (2013.01); *F25B 2313/0272* (2013.01); *F25B 2313/023* (2013.01); *F25B 2309/061* (2013.01); *F25B 25/005* (2013.01); *F25B 2313/02741* (2013.01); *F25B 41/003* (2013.01); *F25B 2313/02732* (2013.01)
USPC ..... 62/192; 62/468

(58) Field of Classification Search
CPC ..... F25B 13/00; F25B 30/02; F25B 41/00; F25B 41/06; F25B 41/046; F25B 31/002; F25B 2400/075; F25B 31/004
USPC ..... 62/238.7, 324.6, 468
See application file for complete search history.

(56) References Cited

U.S. PATENT DOCUMENTS 5,490,399 A * 2/1996 Sada ..... 62/510
6,298,683 B1 * 10/2001 Kondo et al. ..... 62/335

(Continued)

FOREIGN PATENT DOCUMENTS

CN 100473922 C 4/2009
CN 101523149 A 9/2009

(Continued)

OTHER PUBLICATIONS

Office Action (Decision of Rejection) issued Oct. 8, 2013, by the Japanese Patent Office in corresponding Japanese Patent Application No. 2011-553624, and an English Translation of the Office Action. (3 pages).

(Continued)

*Primary Examiner* — Mohammad M Ali
(74) *Attorney, Agent, or Firm* — Buchanan Ingersoll & Rooney PC

(57) ABSTRACT

A refrigeration cycle apparatus includes a refrigerant circuit of a refrigeration cycle through which a refrigerant that transits in a supercritical state is allowed to flow, and a flow dividing device that divides the flow of a high-pressure liquid refrigerant in a subcritical state into two or more parts. The flow dividing device is configured such that the device is oriented substantially in the horizontal direction or substantially upward in the vertical direction relative to the direction of flow of the refrigerant in a liquid state. With such a configuration, the flow of refrigerating machine oil is equally divided, thus offering high energy saving while keeping heat-medium conveyance power at a low level without reducing the heat exchanging performance.

9 Claims, 12 Drawing Sheets

(56) References Cited

U.S. PATENT DOCUMENTS

| | | | | |
|---|---|---|---|---|
| 6,735,973 | B2 * | 5/2004 | Lee | 62/324.6 |
| 6,990,822 | B2 * | 1/2006 | Matsuoka | 62/224 |
| 7,493,775 | B2 * | 2/2009 | Shimamoto et al. | 62/199 |
| 7,607,317 | B2 * | 10/2009 | Honda et al. | 62/324.1 |
| 7,984,620 | B2 * | 7/2011 | Shimamoto et al. | 62/324.1 |
| 8,015,836 | B2 * | 9/2011 | Kameyama et al. | 62/335 |
| 8,650,897 | B2 * | 2/2014 | Honda | 62/324.1 |
| 2006/0162353 | A1 * | 7/2006 | Ha et al. | 62/149 |
| 2006/0179867 | A1 * | 8/2006 | Ha et al. | 62/324.1 |
| 2006/0254294 | A1 * | 11/2006 | Shimamoto et al. | 62/238.7 |
| 2006/0260354 | A1 | 11/2006 | Nakatani et al. | |
| 2007/0113582 | A1 | 5/2007 | Sao et al. | |
| 2007/0234752 | A1 * | 10/2007 | Otake et al. | 62/324.6 |
| 2011/0088421 | A1 | 4/2011 | Wakamoto et al. | |

FOREIGN PATENT DOCUMENTS

| | | | |
|---|---|---|---|
| EP | 2077429 | A1 | 7/2009 |
| JP | 60-114662 | A | 6/1985 |
| JP | 64-079555 | A | 3/1989 |
| JP | 5-280818 | A | 10/1993 |
| JP | 9-101070 | A | 4/1997 |
| JP | 10-318628 | A | 12/1998 |
| JP | 2001-289465 | A | 10/2001 |
| JP | 2003-139420 | A | 5/2003 |
| JP | 2003-343936 | A | 12/2003 |
| JP | 2005-140444 | A | 6/2005 |
| JP | 2005-337524 | A | 12/2005 |
| JP | 2006-300488 | A | 11/2006 |
| JP | 2008-122059 | A | 5/2008 |
| JP | 2008-241086 | A | 10/2008 |
| WO | 20091133640 | A1 | 11/2009 |

OTHER PUBLICATIONS

Office Action (Notice of Reasons for Rejection) dated Jun. 4, 2013, issued in corresponding Japanese Patent Application No. 2011-553624, and an English Translation of the Office Action (7 pages).

International Search Report (PCT/ISA/210) issued on Apr. 13, 2010, by the Japanese Patent Office as the International Searching Authority for International Application No. PCT/JP2010/000838.

Office Action issued on Jan. 10, 2014, by the Chinese Patent Office in corresponding Chinese Patent Application No. 2010800635033, and an English Translation of the Office Action. (25 pages).

Office Action issued on Aug. 20, 2014, by the Chinese Patent Office in corresponding Chinese Patent Application No. 201080063503.3 and an English Translation of the Office Action. (17 pages).

Office Action (Notice of Reasons for Refusal) issued on Sep. 2, 2014, by the Japan Patent Office in corresponding Japanese Patent Application No. 2013-267859, and an English Translation of the Office Action. (14 pages).

* cited by examiner

REFRIGERATION CYCLE APPARATUS

TECHNICAL FIELD

The present invention relates to a refrigeration cycle apparatus that is applied to a multi-air-conditioning apparatus for a building and the like and, more particularly, relates to a refrigeration cycle apparatus in which a pressure of a high-pressure side exceeds a critical pressure of a refrigerant.

BACKGROUND ART

In conventional air-conditioning apparatuses such as a multi-air-conditioning apparatus for a building, which is one of a refrigeration cycle apparatus, cooling operation or heating operation is carried out by circulating a refrigerant between an outdoor unit that is a heat source device disposed outdoors and indoor units disposed indoors. Specifically, a conditioned space is cooled with the air that has been cooled by the refrigerant removing heat from the air and is heated with the air that has been heated by the refrigerant transferring its heat. Conventionally, HFC (hydrofluorocarbon) based refrigerants have been commonly used as refrigerants for such air-conditioning apparatuses. These refrigerants have been made to work in a subcritical region that is a pressure lower than its critical pressure.

However, in recent years, ones using natural refrigerants such as carbon dioxide ($CO_2$) have been proposed. Since carbon dioxide has a low critical temperature, the refrigeration cycle is carried out in a supercritical state in which the refrigerant pressure in a gas cooler on the high-pressure side exceeds its critical pressure. In this case, there is a possibility of the refrigerating machine oil flowing with the refrigerant not separating uniformly in the flow branching portion as it should, and in such a case, there is a possibility of the heat exchanging performance of the refrigeration cycle being impaired.

Further, in an air-conditioning apparatus represented by a chiller system, cooling or heating is carried out such that cooling energy or heating energy is generated in a heat source device disposed outdoors; a heat medium such as water or brine is heated or cooled in a heat exchanger disposed in an outdoor unit; and the heat medium is conveyed to indoor units, such as a fan coil unit, a panel heater, or the like, disposed in the conditioning space (for example, see Patent Literature 1).

Moreover, there is a heat source side heat exchanger called a heat recovery chiller that connects a heat source unit to each indoor unit with four water pipings arranged therebetween, supplies cooled and heated water or the like simultaneously, and allows the cooling and heating in the indoor units to be selected freely (for example. see Patent Literature 2).

In addition, there is an air-conditioning apparatus that disposes a heat exchanger for a primary refrigerant and a secondary refrigerant near each indoor unit in which the secondary refrigerant is conveyed to the indoor unit (see Patent Literature 3, for example).

Furthermore, there is an air-conditioning apparatus that connects an outdoor unit to each branch unit including a heat exchanger with two pipings in which a secondary refrigerant is carried to the corresponding indoor unit (see Patent Literature 4, for example).

CITATION LIST

Patent Literature

Patent Literature 1: Japanese Unexamined Patent Application Publication No. 2005-140444 (p. 4, FIG. 1, for example)

Patent Literature 2: Japanese Unexamined Patent Application

Publication No. 5-280818 (pp. 4 and 5, FIG. 1, for example)

Patent Literature 3: Japanese Unexamined Patent Application Publication No. 2001-289465 (pp. 5 to 8, FIG. 1, FIG. 2, for example)

Patent Literature 4: Japanese Unexamined Patent Application Publication No. 2003-343936 (p. 5, FIG. 1)

SUMMARY OF INVENTION

Technical Problem

Since carbon dioxide has a low global warming potential, effect to the global environment can be reduced. However, in a case of refrigerants with low critical temperature, such as carbon dioxide, the refrigeration cycle is carried out in a supercritical state in which the refrigerant pressure in a gas cooler on the high-pressure side exceeds its critical pressure. In such a case, a situation in which the refrigerating machine oil flowing with the refrigerant not being separated uniformly in a flow branching portion as it should has occurred resulting in a possibility of the heat exchanging performance of the refrigeration cycle being impaired.

Further, in conventional air-conditioning apparatuses such as a multi-air-conditioning apparatus for a building, since the refrigerant is circulated to an indoor unit, there is a possibility of refrigerant leaking into an indoor space, for example. Accordingly, as the refrigerant, only nonflammable refrigerants are used and it has not been possible to use a flammable refrigerant with a low global warming potential from safety considerations. On the other hand, in air-conditioning apparatuses disclosed in Patent Literature 1 and Patent Literature 2, the refrigerant circulates only within the heat source unit disposed outdoors without the refrigerant passing through the indoor unit, such that even if a flammable refrigerant is used as the refrigerant, no refrigerant will leak into the indoor space. However, in the air-conditioning apparatus disclosed in Patent Literature 1 and Patent Literature 2, since the heat medium needs to be heated or cooled in a heat source unit disposed outside a structure, and needs to be conveyed to the indoor unit side, the circulation path of the heat medium becomes long. In this case, while heat for a certain heating or cooling work is conveyed, if the circulation path is long, energy consumption of the conveyance power becomes exceedingly large compared to the energy consumption of an air-conditioning apparatus that conveys the refrigerant into the indoor unit. This indicates that energy saving can be achieved in an air-conditioning apparatus if the circulation of the heat medium can be controlled appropriately.

In the air-conditioning apparatus disclosed in Patent Literature 2, the four pipings connecting the outdoor side and the indoor space need to be arranged in order to allow cooling or heating to be selectable in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also creates a large noise, and is not practical. In addition, since the heat exchanger is disposed near each indoor unit, the risk of refrigerant leakage to a place near an indoor space cannot be eliminated and thus has not allowed the use of flammable refrigerants.

In the air-conditioning apparatus disclosed in Patent Literature 4, a primary refrigerant that has exchanged heat flows into the same passage as that of the primary refrigerant before heat exchange. Accordingly, when a plurality of indoor units are connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

The present invention has been made in consideration of the above-described disadvantages and its primary object is to propose an air-conditioning apparatus capable of achieving energy saving while overcoming the above-described disadvantages caused in a refrigerant flow branching portion in a refrigeration cycle apparatus using, as a refrigerant, carbon dioxide that transits through a supercritical state, for example.

In addition, its secondary object is to cope with the disadvantages recited above.

Solution to Problem

A refrigeration cycle apparatus of the invention includes a refrigerant circuit in which a compressor, a first heat exchanger, an expansion device, and a second heat exchanger are connected; a refrigeration cycle being constituted in which a refrigerant that transits through a supercritical state flows within the refrigerant circuit;

the first heat exchanger being distributed with the refrigerant in a supercritical state and being functioned as a gas cooler, or being distributed with the refrigerant in a subcritical state and being functioned as a condenser;

the second heat exchanger being distributed with the refrigerant in a low-pressure two-phase state and being functioned as an evaporator;

oil or refrigerating machine oil being enclosed within the refrigerant circuit, the oil being immiscible or poorly miscible in the whole of an operating temperature range, the refrigerating machine oil being immiscible or poorly miscible at and above a certain temperature in the operating temperature range and being miscible below the certain temperature; and a flow dividing device being disposed at any position in a passage between the outlet side of the first heat exchanger and the inlet side of the expansion device, the flow dividing device being configured to divide the flow of the refrigerant into two or more parts, wherein the flow dividing device is disposed in a position where the refrigerant is in a liquid state when the refrigerant is operated in the subcritical state, and is configured such that a direction of the refrigerant flowing into the flow dividing device is substantially in a horizontal direction or substantially in a vertically upward direction.

Advantageous Effects of Invention

In the air-conditioning apparatus according to the present invention, the flow dividing device is disposed in a position where the refrigerant is in a liquid state when the refrigerant is operated in the subcritical state, such that the device is oriented substantially in the horizontal direction or substantially upward in the vertical direction relative to the direction of flow of the liquid refrigerant. Since the refrigerating machine oil flowing together with the refrigerant is equally distributed even during operation in the subcritical state, high COP can be maintained while the necessary amount of heat exchanged is kept, thus achieving energy saving.

DESCRIPTION OF EMBODIMENTS

Embodiment 1

Figure 1:
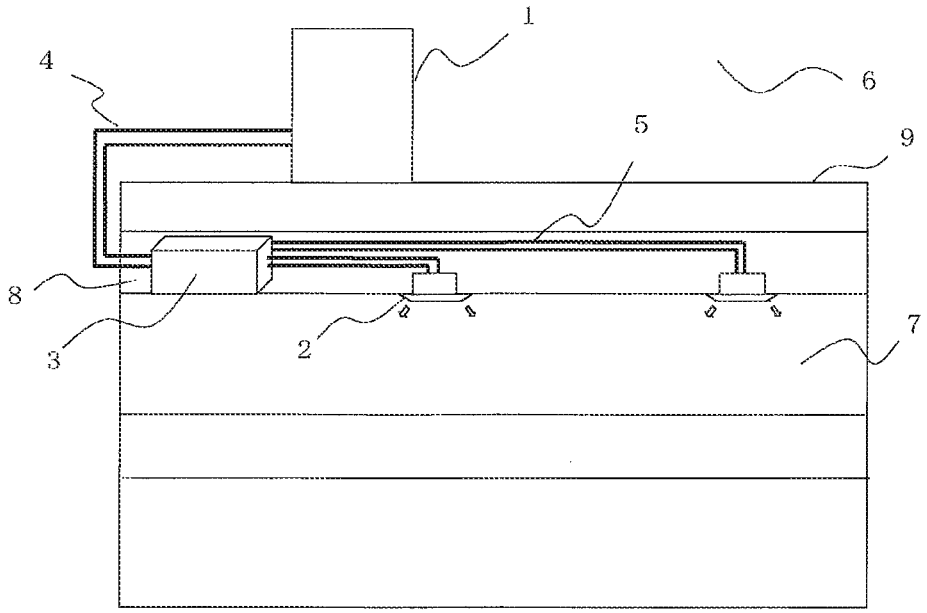
FIG. 1 is a system configuration diagram of a refrigeration cycle apparatus according to Embodiment 1 of the invention.
Figure 2:
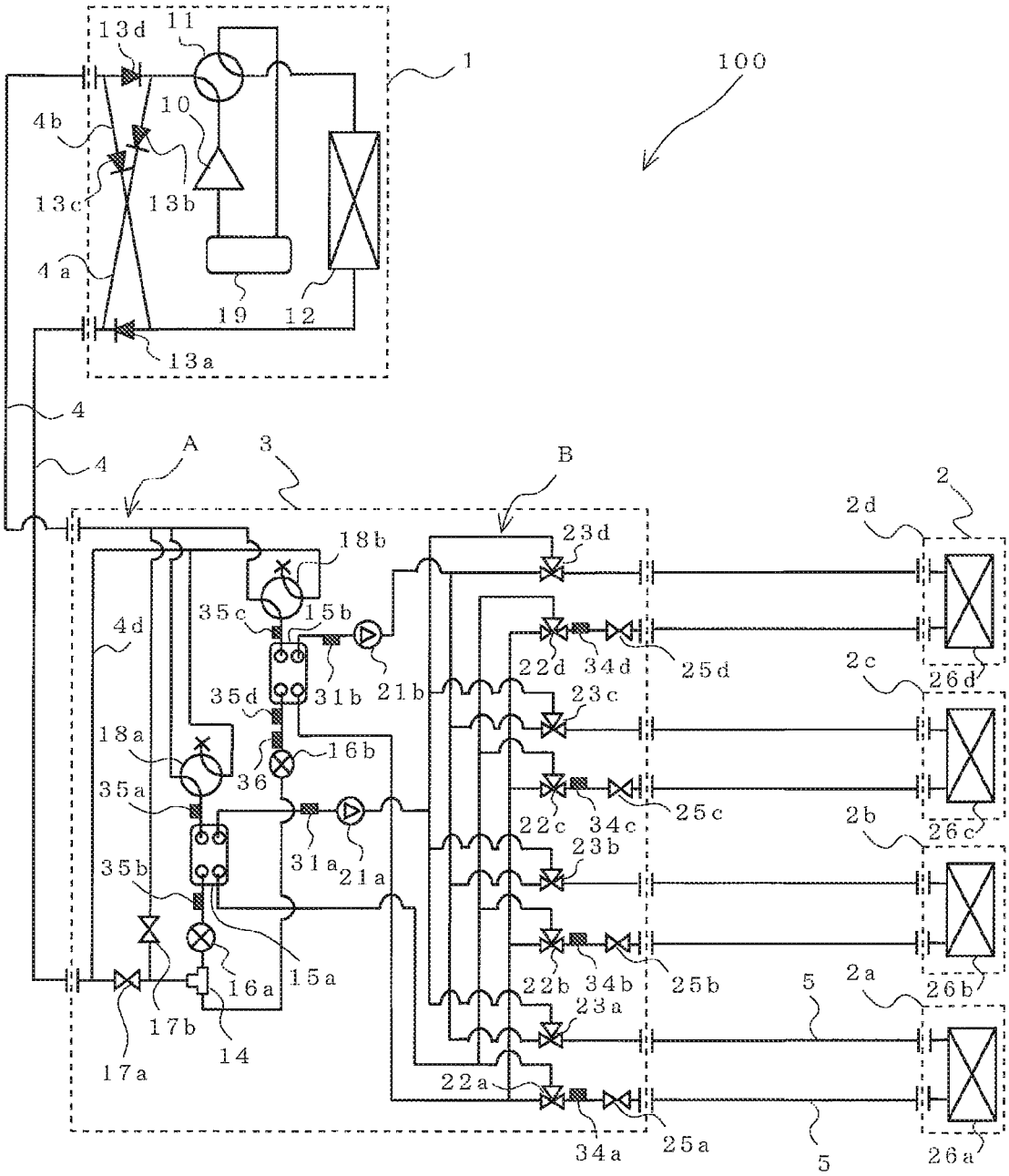
FIG. 2 is a system circuit diagram of the refrigeration cycle apparatus according to Embodiment 1 of the invention.

Embodiment 1 of the invention will be described with reference to the drawings. FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. This air-conditioning apparatus uses refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipings 4 through which the heat source side refrigerant flows. The heat medium relay unit 3 and each indoor unit 2 are connected with pipings 5 through which the heat medium flows. Cooling energy or heating energy generated in the outdoor unit 1 is delivered through the heat medium relay unit 3 to the indoor units 2.

The outdoor unit 1 is typically disposed in an outdoor space 6 that is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is a space (e.g., a living room) inside the structure 9, and supplies air for cooling or air for heating to the indoor space 7 that is a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipings 4 and is connected to the indoor units 2 through the heat medium pipings 5 to convey cooling energy or heating energy, supplied from the outdoor unit 1 to the indoor units 2.

As illustrated in FIG. 1, in the air-conditioning apparatus according to Embodiment 1, the outdoor unit 1 is connected to the heat medium relay unit 3 using two refrigerant pipings 4, and the heat medium relay unit 3 is connected to each indoor unit 2 using two heat medium pipings 5. As described above, in the air-conditioning apparatus according to Embodiment, each of the units (the outdoor unit 1, the indoor units 2, and the heat medium relay unit 3) is connected using two pipings 4 or 5, thus construction is facilitated.

Furthermore, FIG. 1 illustrates a state where the heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, such as a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIG. 1 illustrates a case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

FIG. 2 is a schematic circuit diagram illustrating an exemplary circuit configuration of the air-conditioning apparatus (hereinafter, referred to as an "air-conditioning apparatus 100") according to Embodiment of the invention. The detailed configuration of the air-conditioning apparatus 100 will be described with reference to FIG. 2. As illustrated in FIG. 2, the outdoor unit 1 and the heat medium relay unit 3 are connected with the refrigerant pipings 4 through heat exchangers related to heat medium 15 (15*a* and 15*b*) included in the heat medium relay unit 3. Furthermore, the heat medium relay unit 3 and the indoor units 2 are connected with the pipings 5 through the heat exchangers related to heat medium 15 (15*a* and 15*b*).

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13 (13*a*, 13*b*, 13*c*, and 13*d*). By providing the first connecting piping 4*a*, the second connecting piping 4*b*, the check valves 13*a* to 13*d*, the heat source side refrigerant can be made to flow into the heat medium relay unit 3 in a constant direction irrespective of the operation requested by the indoor units 2.

The compressor 10 sucks in the heat source side refrigerant and compresses the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 functions as an evaporator in the heating operation, functions as a gas cooler in the cooling operation, exchanges heat between air supplied from the air-sending device, such as a fan (not illustrated), and the heat source side refrigerant, and evaporates and gasifies or cools the heat source side refrigerant. The accumulator 19 is provided on the suction side of the compressor 10 and retains excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. Although FIG. 2 illustrates a case where the first connecting piping 4*a*, the second connecting piping 4*b*, and the check valves 13*a* to 13*d* are arranged, any other configuration in which the direction of circulation is the same may be used. Alternatively, these components may be omitted.

[Indoor Units 2]

The indoor units 2 each include a use side heat exchanger 26. The use side heat exchanger 26 is each connected to a heat medium flow control device 25 and a second heat medium flow switching device 23 in the heat medium relay unit 3 with the heat medium pipings 5. Each of the use side heat exchangers 26 exchanges heat between air supplied from an air-sending device, such as a fan, (not illustrated) and the heat medium in order to generate air for heating or air for cooling supplied to the indoor space 7.

FIG. 2 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. As is the case of FIG. 1, the number of connected indoor units 2 illustrated in FIG. 2 is not limited to four.

[Heat Medium Relay Unit 3]

The heat medium relay unit 3 includes the two heat exchangers related to heat medium 15 (15*a* and 15*b*), two expansion devices 16 (16*a* and 16*b*), two on-off devices 17 (17*a* and 17*b*), two second refrigerant flow switching devices 18 (18*a* and 18*b*), two pumps 21 (21*a* and 21*b*), serving as fluid sending devices, four first heat medium flow switching devices 22 (22*a*, 22*b*, 22*c*, and 22*d*), the four second heat medium flow switching devices 23 (23*a*, 23*b*, 23*c*, and 23*d*), and the four heat medium flow control devices 25 (25*a*, 25*b*, 25*c*, and 25*d*).

Each of the two heat exchangers related to heat medium 15 (15*a* and 15*b*) functions as a gas cooler or an evaporator and exchanges heat between the heat source side refrigerant and the heat medium in order to transfer cooling energy or heating energy, generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to heat the heat medium in the cooling and heating mixed operation mode. Additionally, the heat exchanger related to heat medium 15*b* is disposed between an expansion device 16*b* and a second refrigerant flow switching device 18*b* in the refrigerant circuit A and is used to cool the heat medium in the cooling and heating mixed operation mode.

The two expansion devices 16 (16 and 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, such as an electronic expansion valve.

The two on-off devices 17 (17*a* and 17*b*) each include, for example, a two-way valve and open and close the refrigerant piping 4. The on-off device 17*a* is disposed in the refrigerant piping 4 on the inlet side of the heat source side refrigerant. The on-off device 17*b* is disposed in a piping connecting the refrigerant piping 4 on the inlet side of the heat source side refrigerant and the refrigerant piping 4 on an outlet side thereof. The two second refrigerant flow switching devices 18 (18*a* and 18*b*) each include, for example, a four-way valve and switch passages of the heat source side refrigerant in accordance with the operation mode. The second refrigerant flow switching device 18*a* is disposed on the downstream side of the heat exchanger related to heat medium 15*a*, downstream regarding the flow direction of the heat source side refrigerant during the cooling operation, and the second refrigerant flow switching device 18*b* is disposed on the downstream side of the heat exchanger related to heat medium 15*b*, downstream regarding the flow direction of the heat source side refrigerant during the cooling only operation.

The two pumps 21 (21*a* and 21*b*) circulate the heat medium flowing through the heat medium piping 5. The pump 21*a* is disposed in the heat medium piping 5 between the heat exchanger related to heat medium 15*a* and the second heat medium flow switching devices 23. The pump 21*b* is disposed in the heat medium piping 5 between the heat exchanger related to heat medium 15*b* and the second heat medium flow switching devices 23. These pumps 21 may include, for example, a capacity-controllable pump.

The four first heat medium flow switching devices 22 (22*a* to 22*d*) each include, for example, a three-way valve and switches passages of the heat medium. The second heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding heat medium flow control device 25. Furthermore, the devices 22*a*, 22*b*, 22*c*, and 22*d* are illustrated in that order from the bottom of the drawing so as to correspond to the respective indoor units 2.

The four first heat medium flow switching devices 23 (23*a* to 23*d*) each include, for example, a three-way valve and switches passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding use side heat exchanger 26. Furthermore, the devices 23*a*, 23*b*, 23*c*, and 23*d* are illustrated in that order from the bottom of the drawing so as to correspond to the respective indoor units 2.

The four heat medium flow control devices 25 (25*a* to 25*d*) each include, for example, a two-way valve capable of controlling the area of opening and controls the flow rate of the flow in each heat medium piping 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, the devices 25*a*, 25*b*, 25*c*, and 25*d* are illustrated in that order from the bottom of the drawing so as to correspond to the respective indoor units 2. Each of the heat medium flow control devices 25 may be disposed on the inlet side of the heat medium passage of the corresponding use side heat exchanger 26.

The heat medium relay unit 3 includes various detecting devices (two first temperature sensors 31 (31*a* and 31*b*), four second temperature sensors 34 (34*a* to 34*d*), four third temperature sensors 35 (35*a* to 35*d*), and a pressure sensor 36). Information (temperature information and pressure information) detected by these detecting devices are transmitted to a controller (not illustrated) that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching of the second refrigerant flow switching devices 18, and switching of passages of the heat medium.

Each of the two first temperature sensors 31 (31*a* and 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the heat medium piping 5 on the inlet side of the pump 21*a*. The first temperature sensor 31*b* is disposed in the heat medium piping 5 on the inlet side of the pump 21*b*.

Each of the four second temperature sensors 34 (34*a* to 34*d*) is disposed between the corresponding first heat medium flow switching device 22 and heat medium flow control device 25 and detects the temperature of the heat medium flowing out of each use side heat exchanger 26. A thermistor or the like may be used as the second temperature sensor 34. The second temperature sensors 34 are arranged so that the number (four in this case) corresponds to the installed number of indoor units 2. Furthermore, the devices 34*a*, 34*b*, 34*c*, and 34*d* are illustrated in that order from the bottom of the drawing so as to correspond to the respective indoor units 2.

Each of the four third temperature sensors 35 (35*a* to 35*d*) is disposed on the inlet side or the outlet side of a heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-sending device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow direction switching devices 23, and the opening degree of each heat medium flow control device 25 on the basis of the information detected by the various detecting devices and an instruction from a remote control to carry out the operation modes which will be described later. Note that the controller may be provided to each unit, or may be provided to the outdoor unit 1 or the heat medium relay unit 3.

The heat medium pipings 5 in which the heat medium flows include the pipings connected to the heat exchanger related to heat medium 15*a* and the pipings connected to the heat exchanger related to heat medium 15*b*. Each heat medium piping 5 is branched (into four in this case) in accordance with the number of indoor units 2 connected to the heat medium relay unit 3. The heat medium pipings 5 are connected with the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, refrigerant passages of the heat exchangers related to heat medium 15, the expansion devices 16, and the accumulator 19 are connected through the refrigerant piping 4, thus forming the refrigerant circuit A. In addition, heat medium passages of the heat exchanger related to heat medium 15, the pumps 21, the first heat medium flow switching devices 22, the heat medium flow control devices 25, the use side heat exchangers 26, and the second heat medium flow switching devices 23 are connected through the heat medium pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and 15*b* arranged in the heat medium relay unit 3. The heat medium relay unit 3 and each indoor unit 2 are connected through the heat exchanger related to heat medium 15*a* and 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Various operation modes executed by the air-conditioning apparatus 100 will now be described. The air-conditioning apparatus 100 allows each indoor unit 2, on the basis of an instruction from the indoor unit 2, to perform a cooling operation or heating operation. Specifically, the air-conditioning apparatus 100 may allow all of the indoor units 2 to perform the same operation and also allow each of the indoor units 2 to perform different operations.

The operation modes carried out by the air-conditioning apparatus 100 include a cooling only operation mode in which all of the operating indoor units 2 perform the cooling operation, a heating only operation mode in which all of the operating indoor units 2 perform the heating operation, a cooling main operation mode in which cooling load is larger, and a heating main operation mode in which heating load is larger. The operation modes will be described below with respect to the flow of the heat source side refrigerant and that of the heat medium.

[Cooling Only Operation Mode]

Figure 3:
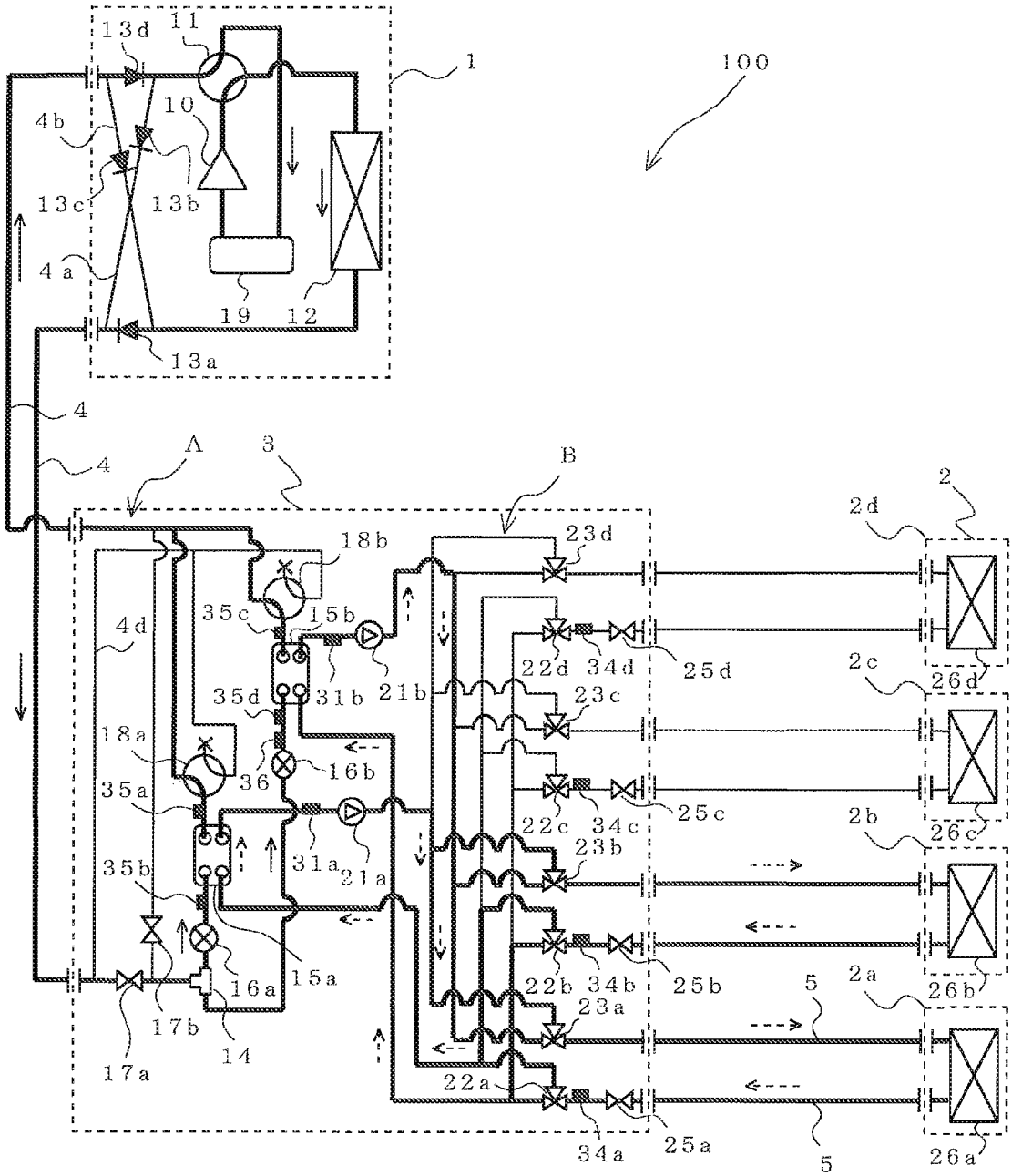
FIG. 3 is a system circuit diagram of the refrigeration cycle apparatus according to Embodiment 1 of the invention during a cooling only operation.

FIG. 3 is a refrigerant circuit diagram illustrating the flows of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 3. Furthermore, in FIG. 3, pipings indicated by thick lines correspond to pipings through which the heat source side refrigerant flows and pipings through which the heat medium flows. The direction of flow of the heat source side refrigerant is indicated by solid-line arrows and the direction of flow of the heat medium is indicated by broken-line arrows.

Figure 7:
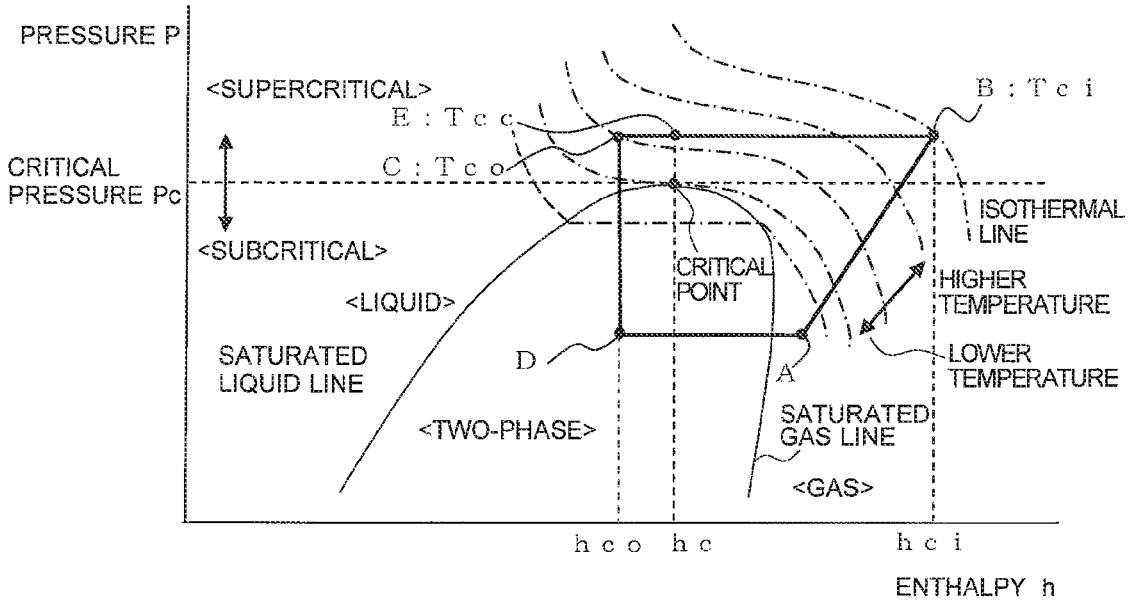
FIG. 7 is a P-h diagram (pressure—enthalpy diagram) of the refrigeration cycle apparatus according to Embodiment 1 of the invention.
Figure 8:
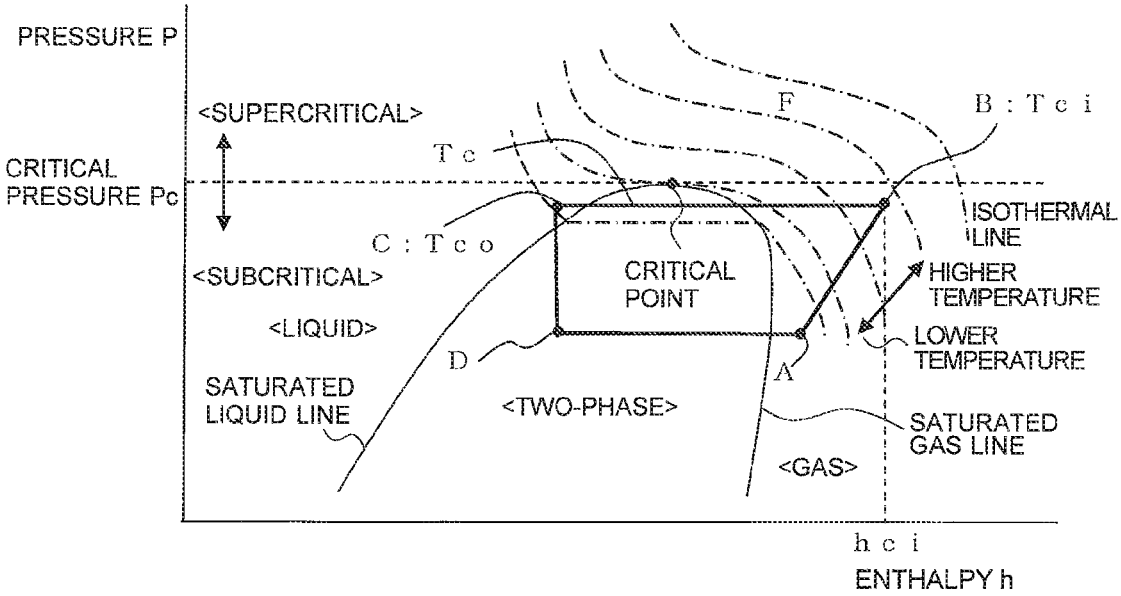
FIG. 8 is another P-h diagram (pressure—enthalpy diagram) of the refrigeration cycle apparatus according to Embodiment 1 of the invention.

Furthermore, FIG. 7 is a P-h diagram illustrating a refrigeration cycle operation in which a high-pressure side transits through a supercritical state. FIG. 8 is a P-h diagram illustrating a refrigeration cycle operation in which a high-pressure side is in a subcritical state. Under normal environmental conditions, the refrigeration cycle is operated such that the high-pressure side is in the supercritical state as illustrated in FIG. 7. During a cooling operation at low outside air temperature (cooling operation at a low ambient temperature), the operation is performed under a condition in which a high pressure is low, such that the refrigeration cycle is operated in the subcritical state as illustrated in FIG. 8.

In the cooling only operation mode illustrated in FIG. 3, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant (at a point A in FIG. 7 or 8) is compressed by the compressor 10 and is discharged as a high-temperature high-pressure refrigerant in a supercritical or subcritical state (at a point B in FIG. 7 or 8) therefrom. The high-temperature high-pressure refrigerant in the supercritical or subcritical state that has been discharged from the compressor 10 flows through the first refrigerant flow switching device 11 into the heat source side heat exchanger 12. Then, the heat source side heat exchanger 12 functions as a gas cooler or a condenser and transfers heat to the outdoor air, thus cooling the refrigerant into a middle-temperature high pressure refrigerant that is in a supercritical or subcritical state (at a point C in FIG. 7 or 8). At this point, when the refrigerant is in the supercritical state above its critical point, the temperature of the refrigerant changes while kept in the supercritical state in which the refrigerant is neither gas nor liquid and when the refrigerant is in the subcritical state, the refrigerant enters a two-phase state and then turns into a liquid refrigerant. The middle-temperature high pressure refrigerant in the supercritical or subcritical state that has flowed out of the heat source side heat exchanger 12 passes through the check valve 13*a*, flows out of the outdoor unit 1, passes through the refrigerant piping 4, and flows into the heat medium relay unit 3. The middle-temperature high pressure refrigerant in the supercritical or subcritical state that has flowed into the heat medium relay unit 3 is branched by a flow dividing device 14 after passing through the on-off device 17*a* and is expanded into a low-temperature low-pressure two-phase refrigerant by the expansion device 16*a* and the expansion device 16*b* (point D of FIG. 7 or 8).

This two-phase refrigerant flows into each of the heat exchanger related to heat medium 15*a* and the heat exchanger related to heat medium 15*b*, functioning as evaporators, removes heat from the heat medium circulating in the heat medium circuit B, cools the heat medium, and turns into a low-temperature low-pressure gas refrigerant (point A of FIG. 7 or 8). The gas refrigerant that has flowed out of the heat exchangers related to heat medium 15*a* and 15*b*, passes through the second refrigerant flow switching device 18*a* and 18*b*, respectively, flows out of the heat medium relay unit 3, and flows into the outdoor unit 1 again through the refrigerant piping 4. The refrigerant that has flowed into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, in which the superheat is obtained as the difference between a temperature detected by a third temperature sensor 35*c* and that detected by a third temperature sensor 35*d*. Additionally, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the heat medium pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cools the indoor space 7.

Then, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 3, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 4:
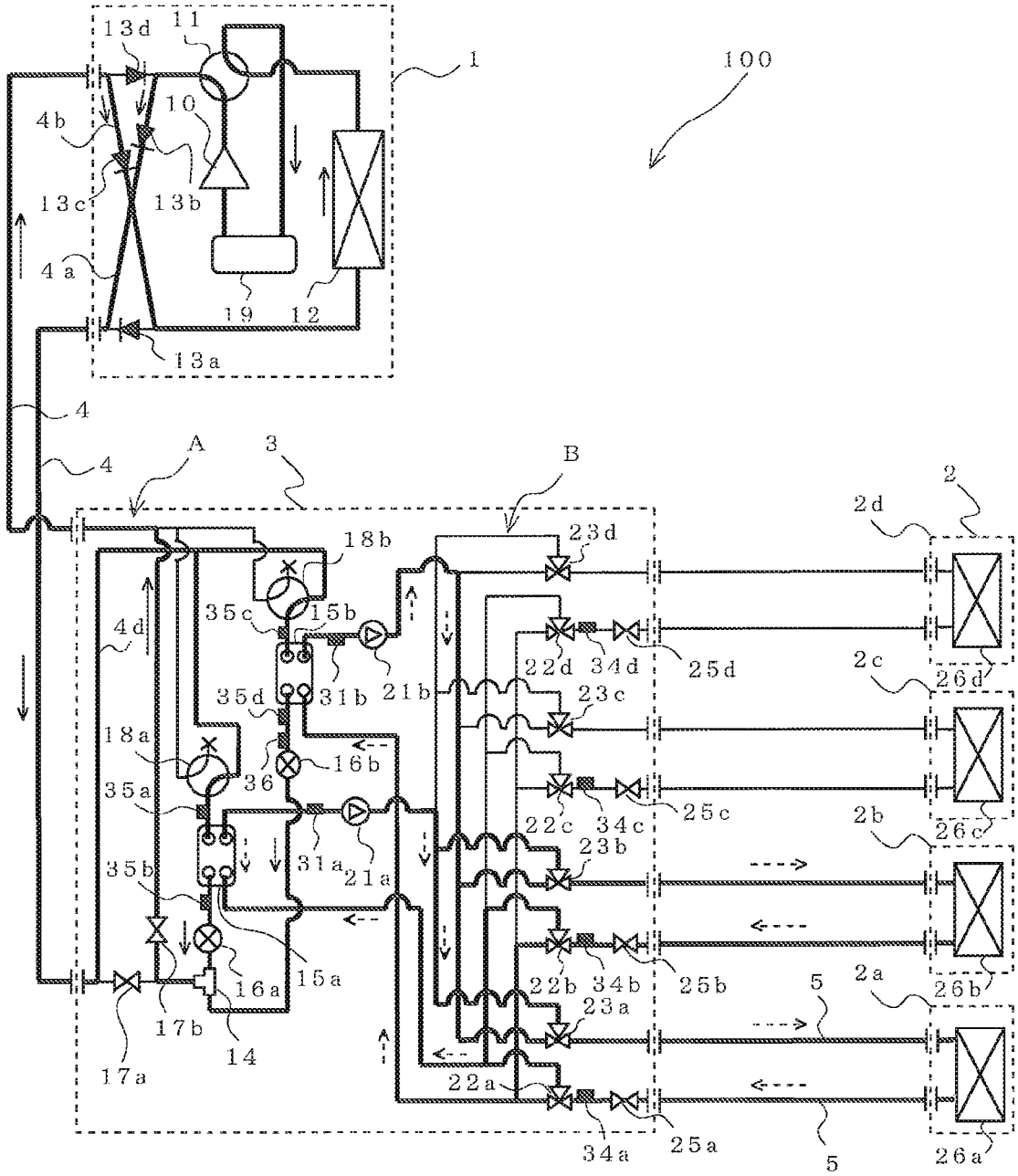
FIG. 4 is a system circuit diagram of the air-conditioning apparatus according to Embodiment 1 during a heating only operation.

FIG. 4 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 4. Furthermore, in FIG. 4, pipings indicated by thick lines correspond to pipings through which the heat source side refrigerant flows and pipings through which the heat medium flows. The direction of flow of the heat source side refrigerant is indicated by solid-line arrows and the direction of flow of the heat medium is indicated by broken-line arrows.

In the heating only operation mode illustrated in FIG. 4, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant (at a point A in FIG. 7 or 8) is compressed by the compressor 10 and is discharged as a high-temperature high-pressure refrigerant in a supercritical or subcritical state (at a point B in FIG. 7 or 8) therefrom. The high-temperature high-pressure refrigerant in the supercritical or subcritical state that has been discharged from the compressor 10 passes through the first refrigerant flow switching device 11, flows through the first connecting piping 4*a*, passes through the check valve 13*b*, and flows out of the outdoor unit 1. The high-temperature high-pressure refrigerant in the supercritical or subcritical state that has flowed out of the outdoor unit 1 passes through the refrigerant piping 4 and flows into the heat medium relay unit 3. The high-temperature high-pressure refrigerant in the supercritical or subcritical state that has flowed into the heat medium relay unit 3 is branched after flowing through the heat-medium-related heat exchanger bypass piping 4*d*, passes through each of the second refrigerant flow switching device 18*a* and the second refrigerant flow switching device 18*b*, and flows into the corresponding one of the heat exchanger related to heat medium 15*a* and the heat exchanger related to heat medium 15*b*.

The high-temperature high-pressure refrigerant in the supercritical or subcritical state that has flowed into the heat exchanger related to heat medium 15*a* and the heat exchanger related to heat medium 15*b* transfers heat in the heat exchanger related to heat medium 15*a* and the heat exchanger related to heat medium 15*b* each functioning as a gas cooler or a condenser to the heat medium circulating in the heat medium circuit B, is cooled, and is turned into a middle-temperature high pressure refrigerant in a supercritical or subcritical state (point C of FIG. 7 or 8). When the refrigerant in the gas cooler is in the supercritical state above its critical point, the temperature of the refrigerant changes while kept in the supercritical state in which the refrigerant is neither gas nor liquid and when the refrigerant in the condenser is in the subcritical state, the refrigerant enters a two-phase state and then turns into a liquid refrigerant. The middle-temperature high pressure refrigerant in a supercritical or subcritical state flowing out of the heat exchanger related to heat medium 15*a* and the heat exchanger related to heat medium 15*b* are expanded into a low-temperature low-pressure, two-phase refrigerant in the expansion device 16*a* and the expansion device 16*b* (point D of FIG. 7 or 8). This two-phase refrigerant passes through the on-off device 17*b*, flows out of the heat medium relay unit 3, passes through the refrigerant piping 4, and again flows into the outdoor unit 1. The refrigerant that has flowed into the outdoor unit 1 flows through the second connecting piping 4*b*, passes through the check valve 13*c*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant (point A of FIG. 7 or 8). The low-temperature low-pressure gas refrigerant flowing out of the heat source side heat exchanger 12 passes through the first refrigerant flow switching device 11 and the accumulator 19 and is sucked into the compressor 10 again.

At that time, during operation in which the high-pressure side is in the supercritical state, the opening degree of the expansion device 16*a* is controlled such that subcool (degree of subcooling) is constant, in which the subcool is obtained as the difference between the value indicating a pseudo-saturation temperature (Tcc of FIG. 7) converted from a pressure detected by the pressure sensor 36 and a temperature detected by the third temperature sensor 35*b* (Tco of FIG. 7). In the gas cooler, since the refrigerant is in a supercritical state and does not turn into a two-phase state, there is no saturation temperature. Instead, a pseudo-saturation temperature is used. Similarly, the opening degree of the expansion device 16*b* is controlled such that subcool is constant, in which the subcool is obtained as the difference between the value indicating a pseudo-saturation temperature converted from the pressure detected by the pressure sensor 36 and a temperature detected by the third temperature sensor 35*d*. Furthermore, during operation in which the high-pressure side is in the subcritical state, the opening degree of the expansion device 16*a* is controlled such that subcool (the degree of subcooling) is constant, the subcool being obtained as the difference between a value (Tc in FIG. 8) indicating a saturation temperature (condensing temperature), converted from a pressure detected by the pressure sensor 36, and a temperature (Tco in FIG. 8) detected by the third temperature sensor 35*b*. Similarly, the opening degree of the expansion device 16*b* is controlled such that subcool is constant, in which the subcool is obtained as the difference between the value indicating the saturation temperature (condensing temperature) converted from the pressure detected by the pressure sensor 36 and a temperature detected by the third temperature sensor 35*d*. Note that the on-off device 17*a* is closed and the on-off device 17*b* is opened. Further, when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the heat medium pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Then, the heat medium flows out of the use side heat exchanger 26*a* and the use side heat exchanger 26*b* and flows into the heat medium flow control device 25*a* and the heat medium flow control device 25*b*, respectively. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 4, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 5:
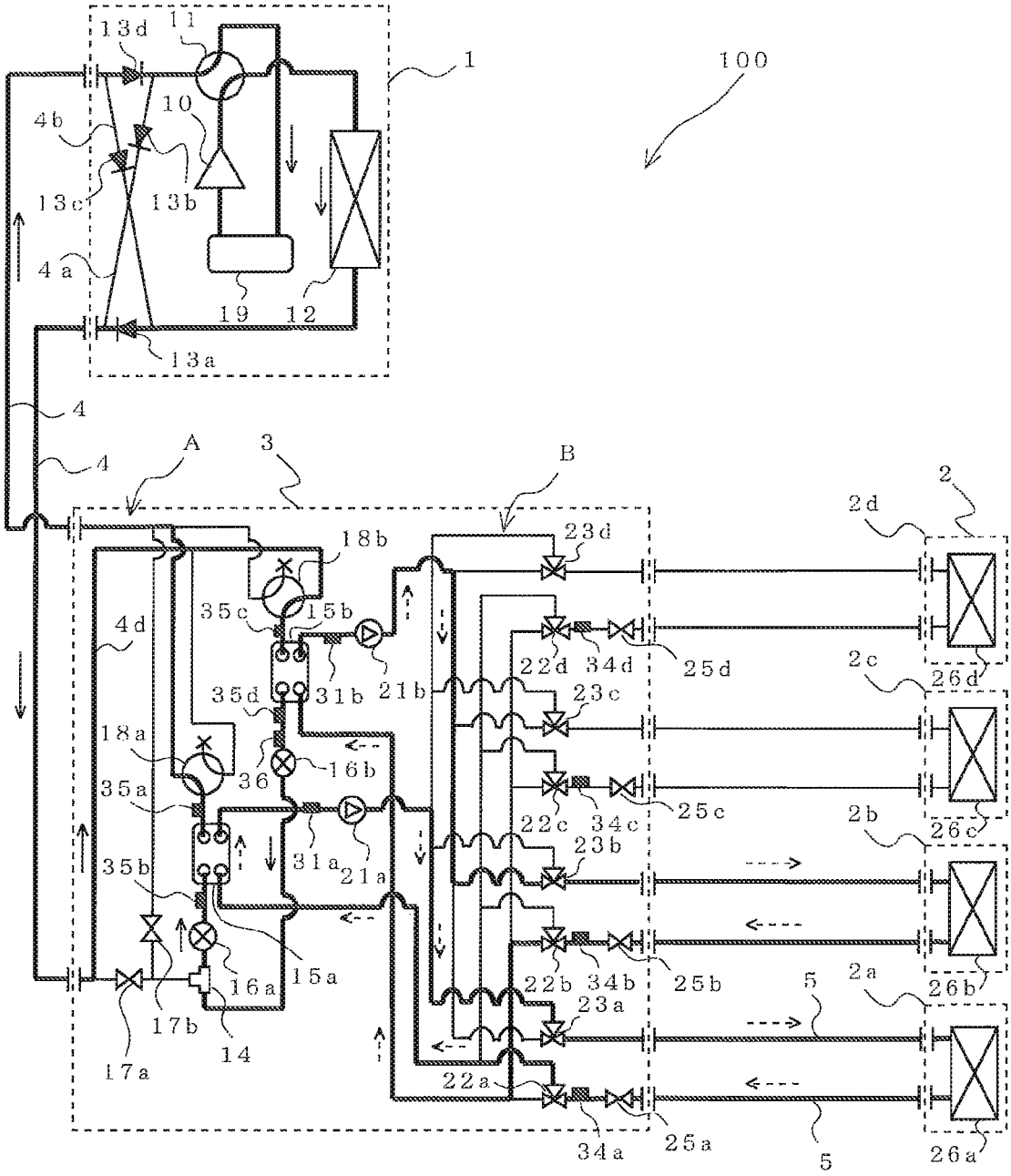
FIG. 5 is a system circuit diagram of the air-conditioning apparatus according to Embodiment 1 during cooling main operation.

FIG. 5 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 5. Furthermore, in FIG. 5, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 5.

In the cooling main operation mode illustrated in FIG. 5, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant (at a point A in FIG. 7 or 8) is compressed by the compressor 10 and is discharged as a high-temperature high-pressure refrigerant in a supercritical or subcritical state (at a point B in FIG. 7 or 8) therefrom. The high-temperature high-pressure refrigerant in the supercritical or subcritical state that has been discharged from the compressor 10 flows through the first refrigerant flow switching device 11 into the heat source side heat exchanger 12. Here, the heat source side heat exchanger 12 functions as a gas cooler or a condenser and the refrigerant is cooled while transferring heat to the outdoor air, flows out of the heat source side heat exchanger 12, passes through the check valve 13*a*, flows out of the outdoor unit 1, passes through the refrigerant piping 4 and flows into the heat medium relay unit 3. The high-temperature high-pressure refrigerant in the supercritical or subcritical state that has flowed into the heat medium relay unit 3 passes through the heat-medium-related heat exchanger bypass piping 4*d*, flows through the second refrigerant flow switching device 18*b*, and flows into the heat exchanger related to heat medium 15*b*, functioning as a gas cooler or a condenser.

The high-temperature high-pressure refrigerant in the supercritical or subcritical state that has flowed into the heat medium heat exchanger 15*b* is cooled while transferring heat to the heat medium circulating in the heat medium circuit B, and turns into a middle-temperature high pressure refrigerant in a supercritical or subcritical state (point C of FIG. 7 or 8). The middle-temperature high pressure refrigerant in the supercritical or subcritical state flowing out of the heat exchanger related to heat medium 15*b* is expanded into a low-pressure two-phase refrigerant (point D of FIG. 7 or 8) by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, cools the heat medium, and turns into a low-pressure gas refrigerant (point A of FIG. 7 or 8). The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant that has flowed into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. Furthermore, during operation in which the high-pressure side is in the supercritical state, the opening degree of the expansion device 16*b* may be controlled such that subcooling is constant, the subcooling being obtained as the difference between a value (Tcc in FIG. 7) indicating a pseudo saturation temperature, converted from a pressure detected by the pressure sensor 36, and a temperature (Tco in FIG. 7) detected by the third temperature sensor 35*d*. During operation in which the high-pressure side is in the subcritical state, the opening degree of the expansion device 16*b* may be controlled such that subcooling is constant, the subcooling being obtained as the difference between a value (Tc in FIG. 8) indicating a saturation temperature (condensing temperature), converted from a pressure detected by the pressure sensor 36, and a temperature (Tco in FIG. 8) detected by the third temperature sensor 35*d*. Alternatively, the expansion device 16*b* may be fully opened and the expansion device 16*a* may control the superheat or the subcool.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the heat medium pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the heat medium pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is sucked into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then sucked into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the heat medium pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 6:
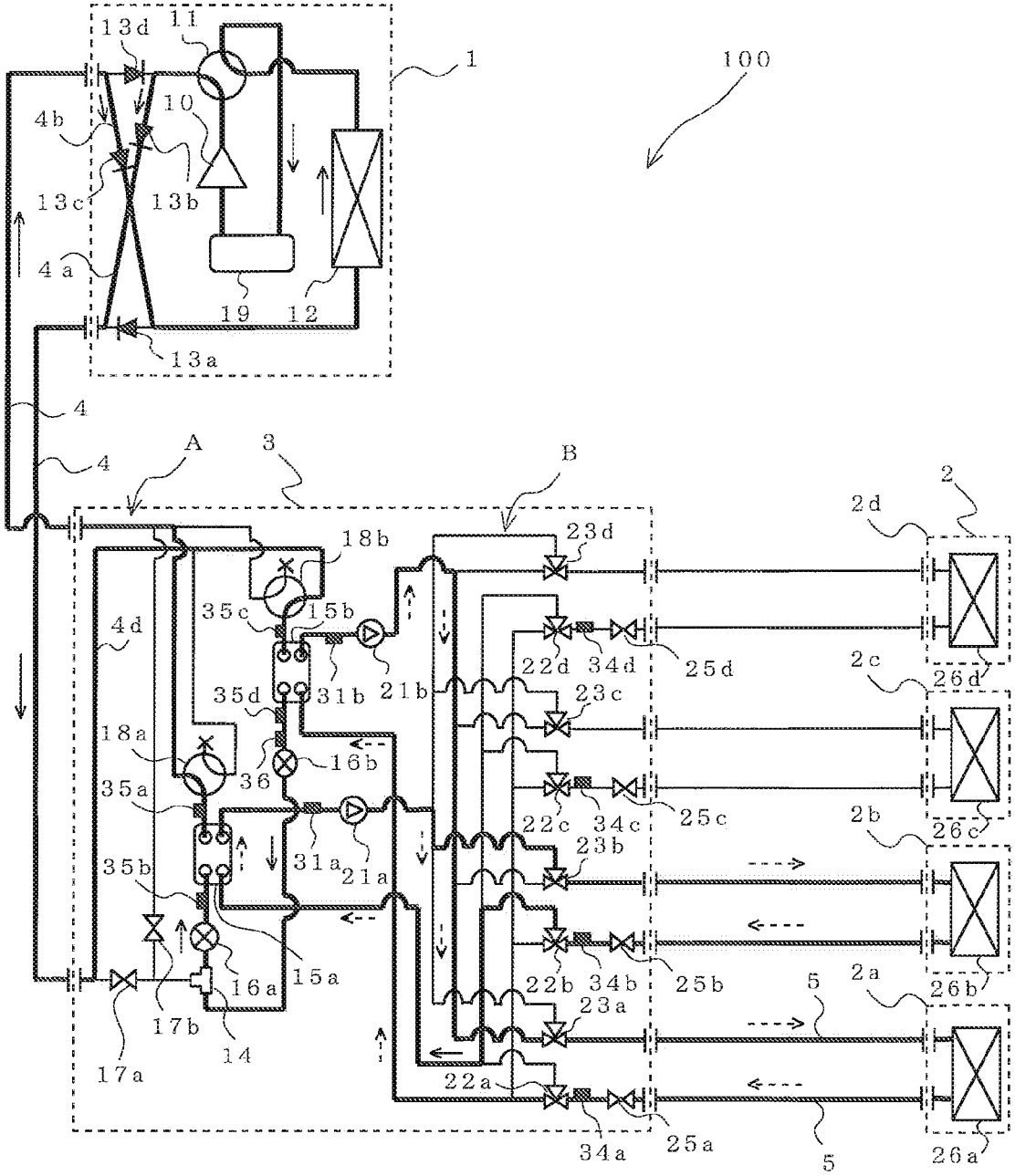
FIG. 6 is a system circuit diagram of the air-conditioning apparatus according to Embodiment 1 during heating main operation.

FIG. 6 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 6. Furthermore, in FIG. 6, pipings indicated by thick lines correspond to pipings through which the heat source side refrigerant circulates and pipings through which the heat medium circulates. The direction of flow of the heat source side refrigerant is indicated by solid-line arrows and the direction of flow of the heat medium is indicated by broken-line arrows.

In the heating main operation mode illustrated in FIG. 6, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant (at a point A in FIG. 7 or 8) is compressed by the compressor 10 and is discharged as a high-temperature high-pressure refrigerant in a supercritical or subcritical state (at a point B in FIG. 7 or 8) therefrom. The high-temperature high-pressure refrigerant in the supercritical or subcritical state that has been discharged from the compressor 10 passes through the first refrigerant flow switching device 11, flows through the first connecting piping 4*a*, passes through the check valve 13*b*, and flows out of the outdoor unit 1. The high-temperature high-pressure refrigerant in the supercritical or subcritical state that has flowed out of the outdoor unit 1 passes through the refrigerant piping 4 and flows into the heat medium relay unit 3. The high-temperature high-pressure refrigerant in the supercritical or subcritical state that has flowed into the heat medium relay unit 3 passes through the heat-medium-related heat exchanger bypass piping 4*d*, flows through the second refrigerant flow switching device 18*b*, and flows into the heat exchanger related to heat medium 15*b*, functioning as a gas cooler or a condenser.

The high-temperature high-pressure refrigerant in the supercritical or subcritical state that has flowed into the heat medium heat exchanger 15*b* is cooled while transferring heat to the heat medium circulating in the heat medium circuit B, and turns into a middle-temperature high pressure refrigerant in a supercritical or subcritical state (point C of FIG. 7 or 8). The middle-temperature high pressure refrigerant in the supercritical or subcritical state flowing out of the heat exchanger related to heat medium 15*b* is expanded into a low-pressure two-phase refrigerant (point D of FIG. 7 or 8) by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant that has flowed into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant (point A of FIG. 7 or 8). The low-temperature low-pressure gas refrigerant flowing out of the heat source side heat exchanger 12 passes through the first refrigerant flow switching device 11 and the accumulator 19 and is sucked into the compressor 10 again.

At that time, during operation in which the high-pressure side is in the supercritical state, the opening degree of the expansion device 16*b* is controlled such that subcool is constant, in which the subcool is obtained as the difference between the value indicating a pseudo-saturation temperature (Tcc of FIG. 7) converted from a pressure detected by the pressure sensor 36 and a temperature detected by the third temperature sensor 35*b* (Tco of FIG. 7). In the gas cooler, since the refrigerant is in a supercritical state and does not turn into a two-phase state, there is no saturation temperature. Instead, a pseudo-saturation temperature is used. Furthermore, during operation in which the high-pressure side is in the subcritical state, the opening degree of the expansion device 16*a* is controlled such that subcool (the degree of subcooling) is constant, the subcool being obtained as the difference between a value (Tc in FIG. 8) indicating a saturation temperature (condensing temperature), converted from a pressure detected by the pressure sensor 36, and a temperature (Tco in FIG. 8) detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcool.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the heat medium pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the heat medium pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is sucked into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the heat medium pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerating Machine Oil]

Refrigerating machine oil is enclosed within the refrigerant circuit in the refrigeration cycle to lubricate the compressor 10 and the like. The refrigerating machine oil is discharged together with the refrigerant from the compressor 10. Most of the discharged refrigerating machine oil is separated from a gas refrigerant with an oil separator (not illustrated) disposed on the discharge side of the compressor 10 and is then returned to the suction side of the compressor 10 through an oil return piping (not illustrated) connecting the oil separator and the suction side of the compressor 10. The refrigerating machine oil, which had not been separated with the oil separator, circulates together with the refrigerant in the refrigeration cycle, such that it passes through the heat exchangers 12 and 15 and the expansion device 16 and is returned to the compressor 10.

Figure 9:
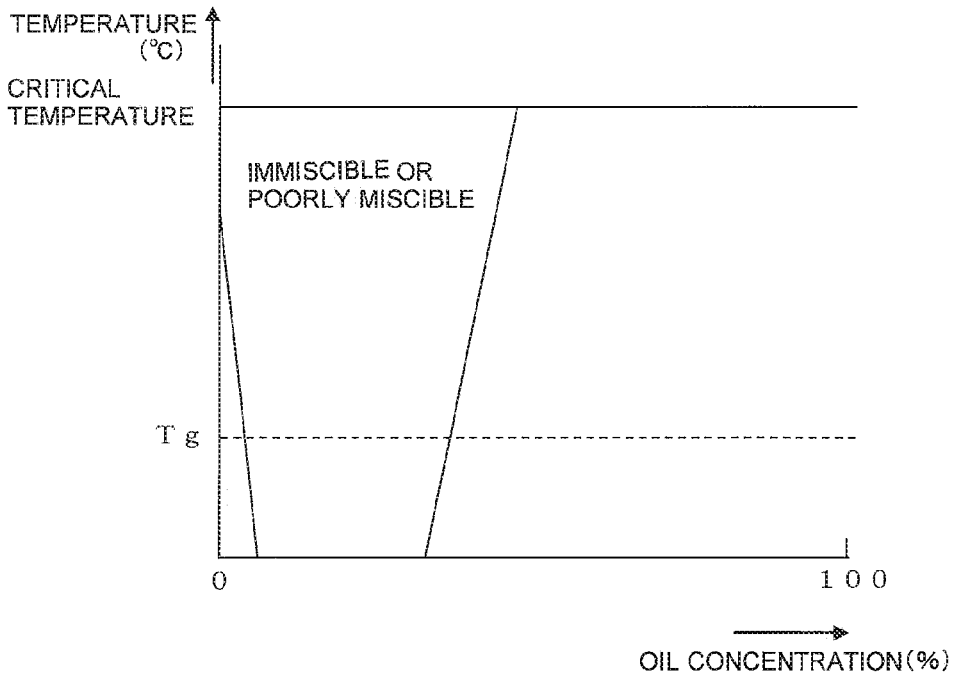
FIG. 9 is a graph illustrating the solubility of refrigerating machine oil in the refrigeration cycle apparatus according to Embodiment 1 of the invention.
Figure 10:
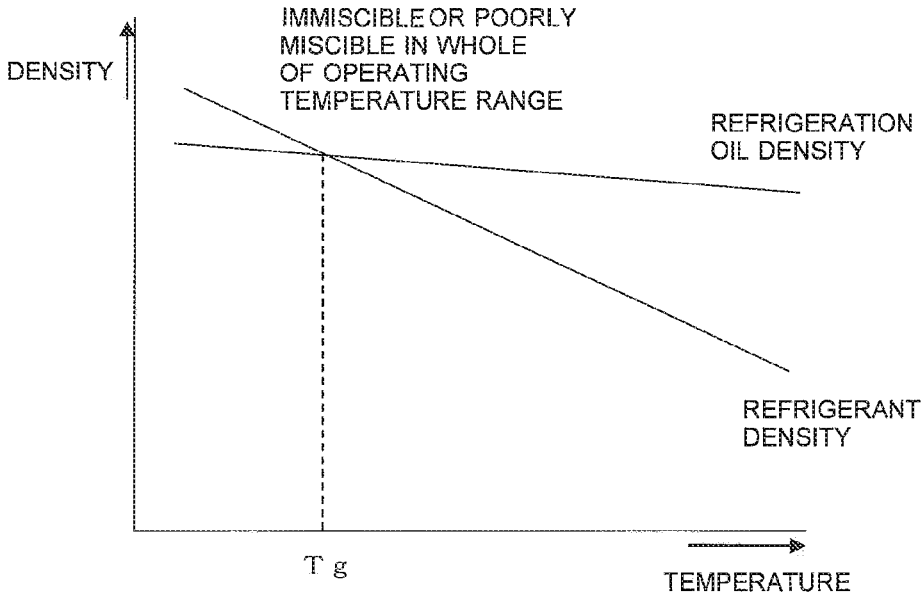
FIG. 10 is a graph illustrating the relationship in temperature and density between a refrigerant and the refrigerating machine oil in the refrigeration cycle apparatus according to Embodiment 1 of the invention.

As regards the refrigerating machine oil, for example, polyalkylene glycol (PAG) or polyol ester (POE) is used. FIG. 9 illustrates a graph of the solubility of PAG with carbon dioxide. PAG is poorly miscible with (immiscible with) carbon dioxide in the whole of the operating temperature range and is hardly soluble therewith. FIG. 10 illustrates the density relationship between PAG and carbon dioxide. The density of PAG, the refrigerating machine oil, is higher (the weight thereof is heavier) than that of the refrigerant at temperatures above a temperature Tg. Whereas, the density of PAG, the refrigerating machine oil, is lower (the weight thereof is lighter) than that of the refrigerant at temperatures below the temperature Tg. In this case, Tg is in a range of −15 degrees C. to −20 degrees C., for example.

Figure 11:
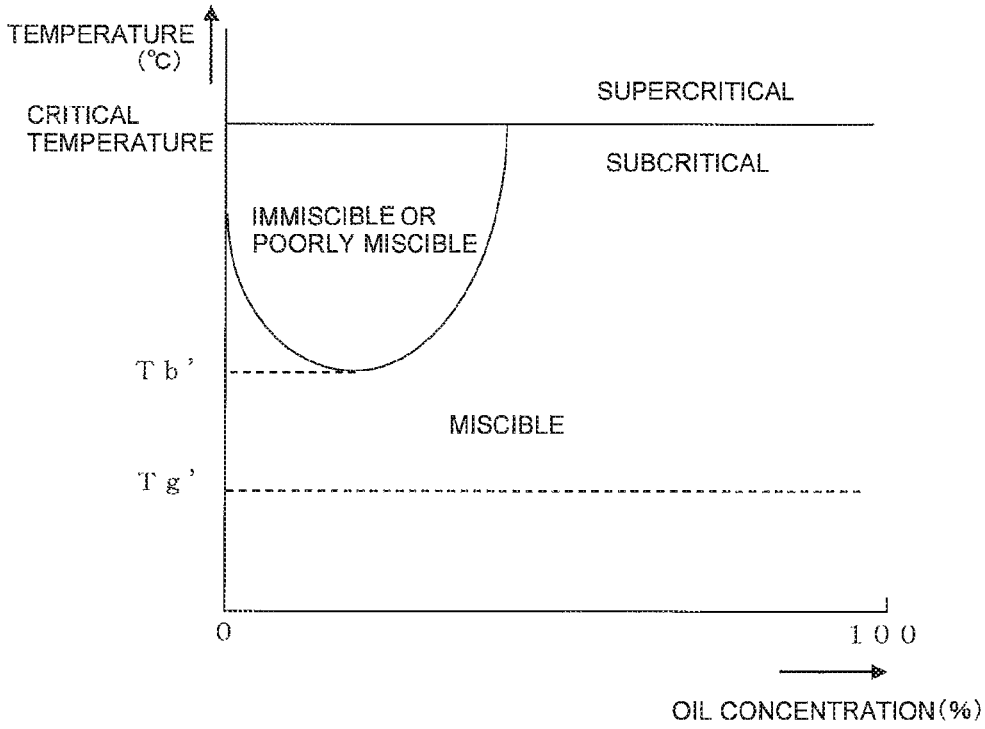
FIG. 11 is a graph illustrating the solubility of another type of refrigerating machine oil in the refrigeration cycle apparatus according to Embodiment 1 of the invention.
Figure 12:
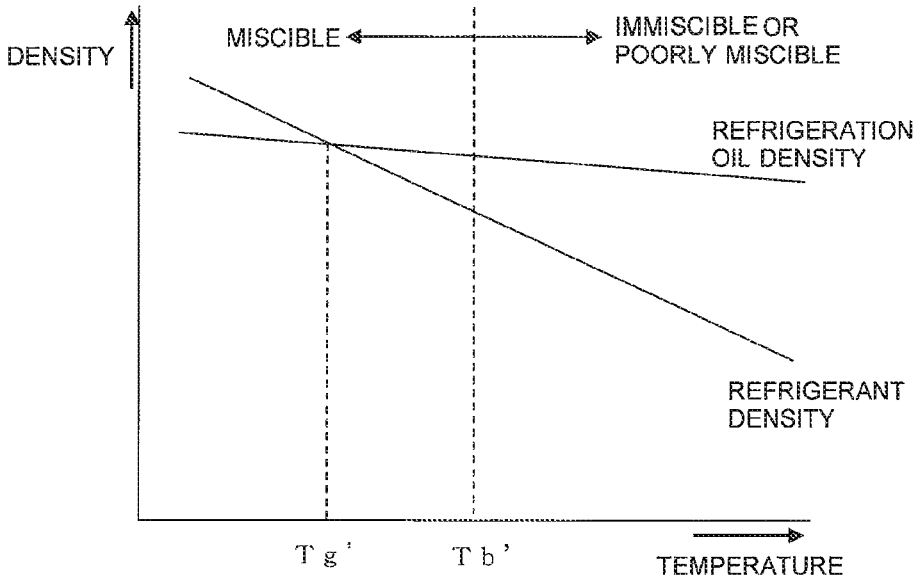
FIG. 12 is a graph illustrating the relationship in temperature and density between another refrigerant and the refrigerating machine oil in the refrigeration cycle apparatus according to Embodiment 1 of the invention.

Furthermore, FIG. 11 illustrates a graph of the solubility of POE with carbon dioxide. In the operating temperature range, POE exhibit poor miscibility with carbon dioxide at a temperature above a temperature Tb', such that the amount of POE dissolved in carbon dioxide is small. At temperatures below Tb', however, POE exhibit miscibility with carbon dioxide, such that POE is dissolved therein. FIG. 12 illustrates the density relationship between POE and carbon dioxide. The density of POE, the refrigerating machine oil, is higher (the weight thereof is heavier) than that of the refrigerant at temperatures above a temperature Tg'. Whereas, the density of POE, the refrigerating machine oil, is lower (the weight thereof is lighter) than that of the refrigerant at temperatures below the temperature Tg'. Furthermore, Tg' denotes a temperature lower than Tb'. The density of POE is higher (the weight thereof is heavier) than that of the refrigerant in a region where POE exhibits poor miscibility. It is in a region where POE exhibits miscibility that the density of POE becomes lower (the weight thereof is lighter) than that of the refrigerant. In this case, Tb' is in a range of 0 degrees C. to 10 degrees C., for example. Tg' is in a range of −15 degrees C. to −20 degrees C., for example. Furthermore, although the temperature Tb' at the boundary between miscibility and poor miscibility of POE has been described as being in the range of 0 degrees C. to 10 degrees C., in actuality, it slightly differs depending on the type of POE, and approximately ranges from −10 degrees C. to 15 degrees C. Although some POE exhibit immiscibility or poor miscibility again at lower temperatures, for example, at and below −45 degrees C., the lower temperatures are not illustrated, since the lower temperatures are outside the actual operating temperature range of the refrigeration cycle apparatus.

Accordingly, when PAG is used as refrigerating machine oil, in the case where the refrigerant is liquid in the subcritical state on the high-pressure side and the temperature thereof is higher than Tg on the low-pressure side, PAG is separated from a liquid carbon dioxide refrigerant, such that PAG sinks underneath the liquid refrigerant. In the case where the temperature of the refrigerant is lower than Tg on the low-pressure side, PAG is separated from the liquid refrigerant, such that PAG floats on the liquid refrigerant. Whereas, when POE is used as a refrigerating machine oil, in the case where the refrigerant is liquid in a subcritical liquid state on the high-pressure side or the temperature of the refrigerant is higher than Tb' on the low-pressure side, for example, at or above 0 degrees C., POE is separated into an oil-rich layer and a refrigerant-rich layer, such that POE sinks underneath the liquid refrigerant. In the case where the refrigerant is at a temperature below Tb' on a low pressure side, POE is miscible with the refrigerant, so that they circulate together in the refrigeration cycle without separating from each other irrespective of their densities.

[Division of Flow of Liquid Refrigerant in Subcritical State]

For example, in a cooling operation at low outside air temperature, the operation state is assumed as follows: a carbon dioxide refrigerant on the high-pressure side is in the subcritical state and the refrigerant is liquid on the outlet side of a condenser. As described above, the liquid refrigerant in the subcritical state separates from the refrigerating machine oil regardless of whether the refrigerating machine oil is PAG or POE. Since the density of the refrigerating machine oil is higher than that of the liquid refrigerant at a temperature at the outlet of the condenser, the refrigerating machine oil circulates together with the refrigerant in a refrigerant circuit of a refrigeration cycle while sinking underneath the liquid refrigerant. Furthermore, in the case where the refrigerating machine oil is PAG, only a very small amount of refrigerant is dissolved in PAG. In the case where the refrigerating machine oil is POE, the amount of refrigerant dissolved in POE is slightly larger than that in PAG but the fact that POE separates into the oil-rich layer and the liquid-refrigerant-rich layer is the same, and, it can be said that in either of the refrigerating machine oil, the refrigerating machine oil circulates together with the refrigerant through the refrigeration cycle while sinking underneath the liquid refrigerant.

Figure 13:
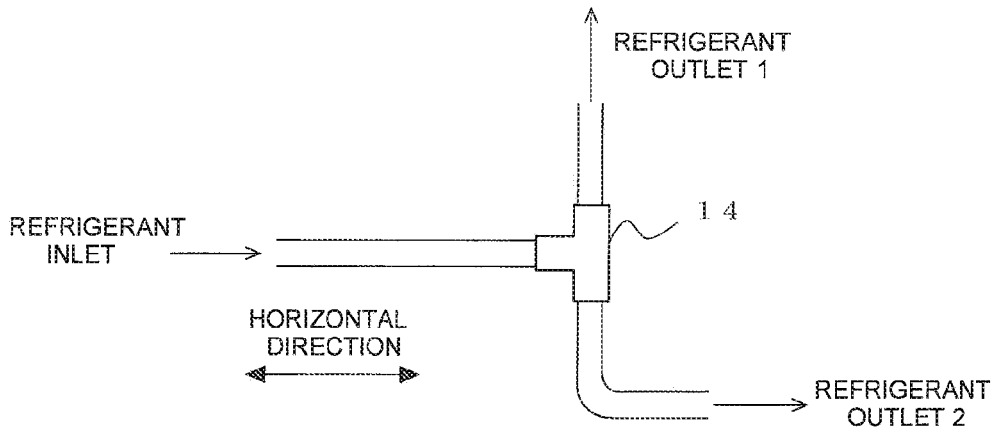
FIG. 13 is an enlarged view of a refrigerant distributing device used in Embodiment 1 of the invention when viewed from above.

In a refrigerant piping through which a liquid refrigerant in the subcritical state flows, there are cases in which the piping have to be branched in order to divide the flow of the refrigerant. For example, in the cooling operation in FIG. 3, when assuming that the refrigerant is in the subcritical state, the refrigerant flows as liquid into the heat medium relay unit 3. This liquid refrigerant passes through the on-off device 17*a* and is then divided into the refrigerant flowing through the expansion device 16*a* into the heat exchanger related to heat medium 15*a* and the refrigerant flowing through the expansion device 16*b* into the heat exchanger related to heat medium 15*b*. At this time, the flow dividing device 14 divides the liquid refrigerant into the refrigerant flowing to the expansion device 16*a* and that flowing to the expansion device 16*b*. Such a flow branching portion is configured as illustrated in FIG. 13, for example. FIG. 13 is a view of the flow branching portion when viewed from above. In this case, a T-shaped branch unit or the like is used as the flow dividing device 14. The liquid refrigerant horizontally flows into the flow dividing device 14, which divides the flow of the liquid refrigerant into two parts in the horizontal direction. The liquid refrigerant and the refrigerating machine oil flow together into the flow dividing device 14. If a considerable amount of oil enters the heat exchanger related to heat medium, the heat exchanging performance will drop. It is therefore necessary to equally distribute the liquid refrigerant and the refrigerating machine oil to each of the two heat exchangers related to heat medium. Since the refrigerating machine oil flows underneath the liquid refrigerant in a separated state, if the flow branching portion is disposed so that the flow is divided substantially horizontally, the liquid refrigerant and the refrigerating machine oil can be equally distributed to the two expansion device and the two heat-medium-related heat exchangers. Advantageously, the heat exchanging performance of each heat exchanger related to heat medium can be maintained, thus leading to energy saving.

Figure 14:
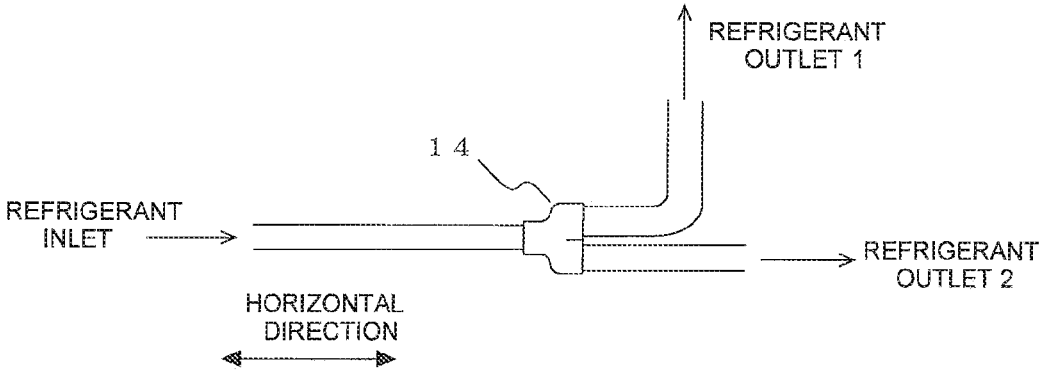
FIG. 14 is an enlarged view of another refrigerant distributing device used in Embodiment 1 of the invention when viewed from above.

Since it is desirable to use a flow dividing device 14, which is inexpensive and has a minimum pressure loss, the T-shaped flow dividing device as illustrated in FIG. 13 is used. In the T-shaped flow dividing device, the flow direction of the refrigerant flowing into the flow dividing device 14 is substantially in a horizontal direction and the flow direction of the refrigerant flowing out of the flow dividing device is substantially in a horizontal direction and is substantially perpendicular to the flow direction of the refrigerant flowing into the flow dividing device. Note that the flow dividing device 14 is not limited to this type. For example, a flow dividing device as illustrated in FIG. 14 may be used in which the flow direction of the refrigerant flowing into the flow dividing device is substantially in a horizontal direction and a direction in which the refrigerant flows out of the flow dividing device is substantially in a horizontal direction and is substantially parallel to the flow direction of the refrigerant flowing into the flow dividing device.

Figure 15:
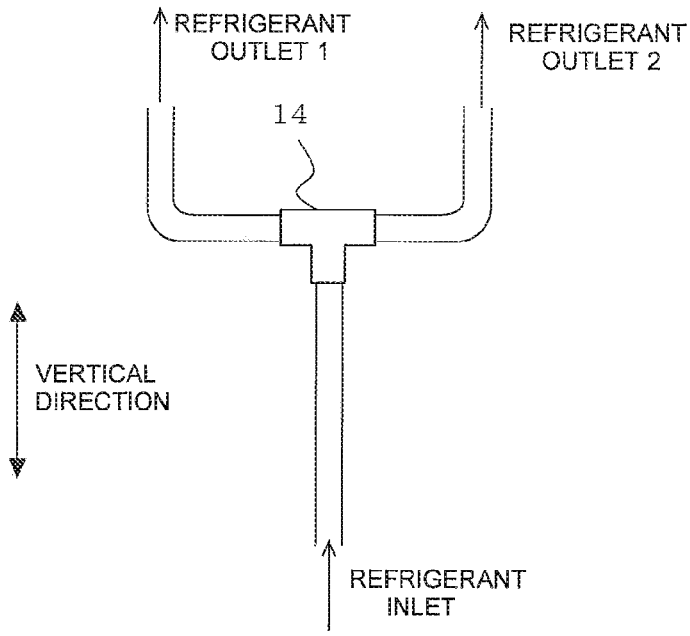
FIG. 15 is an enlarged view of another refrigerant distributing device used in Embodiment 1 of the invention when viewed from a side.
Figure 16:
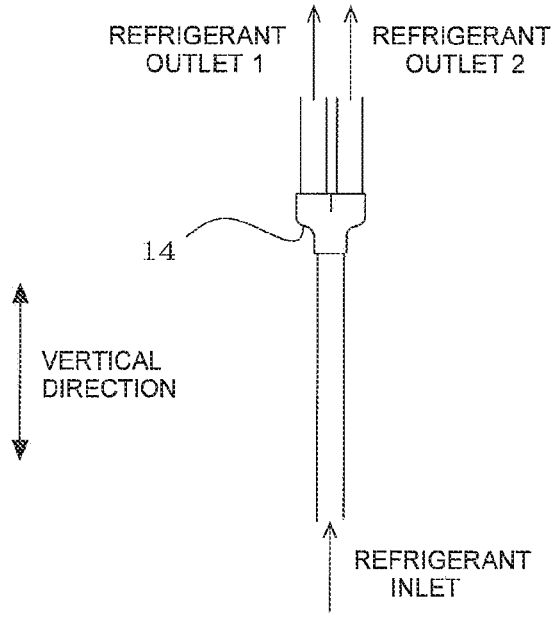
FIG. 16 is an enlarged view of another refrigerant distributing device used in Embodiment 1 of the invention when viewed from a side.

In addition, as illustrated in FIGS. 15 and 16, the flow dividing device 14 may be disposed such that the liquid refrigerant flows vertically upwards into the device. Thus, the liquid refrigerant and the refrigerating machine oil can be equally distributed to the two expansion device and the two heat exchangers related to heat medium. Furthermore, in the refrigerant flow dividing device in FIG. 15, the flow direction of the refrigerant flowing into the flow dividing device is substantially in a vertical direction and the flow direction of the refrigerant flowing out of the flow dividing device is substantially in a horizontal direction and is substantially perpendicular to the flow direction of the refrigerant flowing into the flow dividing device. In the refrigerant flow dividing device illustrated in FIG. 16, the flow direction of the refrigerant flowing into the flow dividing device is substantially in a vertically upward direction and the flow direction of the refrigerant flowing out of the flow dividing device is substantially in a vertically upward direction and is substantially parallel to the flow direction of the refrigerant flowing into the flow dividing device.

Although the case where the flow of the refrigerant is divided into two parts by the refrigerant flow dividing device 14 has been described as an example, the number of parts in the division of flow is not limited to the above. The flow may be divided into three or more parts.

Furthermore, while the case where the flow dividing device 14 is installed in the passage between the on-off device 17*a* and the expansion device 16 has been described as an example, the installation position of the flow dividing device 14 is not limited to the above. For example, assuming that either or each of the expansion device 16*a* and the expansion device 16*b* is configured in terms of cost such that two expansion device having a small area of opening are arranged in parallel, the liquid refrigerant flows into the expansion device 16*a* and 16*b* in the heating operation illustrated in FIG. 4. It is therefore necessary to install the refrigerant flow dividing device 14 in either or each of the passage between the heat exchanger related to heat medium 15*a* and the expansion device 16*a* and the passage between the heat exchanger related to heat medium 15*b* and the expansion device 16*b* such that the flow is divided into parts flowing in the same direction.

[Refrigerant Piping 4]

As described above, the air-conditioning apparatus 100 according to Embodiment 1 has several operation modes. In these operation modes, the heat source side refrigerant flows through the refrigerant pipings 4 connecting the outdoor unit 1 and the heat medium relay unit 3.

[Heat Medium Piping]

In some operation modes carried out by the air-conditioning apparatus 100 according to Embodiment 1, the heat medium, such as water or antifreeze, flows through the heat medium pipings 5 connecting the heat medium relay unit 3 and the indoor units 2.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are set to a medium opening degree, such that the heat medium flows into both of the heat exchanger related to heat medium 15*a* and the heat exchanger related to heat medium 15*b*. Consequently, since both the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment may be any of the sort as long as they can switch passages, for example, a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, while Embodiment has been described with respect to the case in which the heat medium flow control devices 25 each include a two-way valve, each of the heat medium flow control devices 25 may include a control valve having three passages and the valve may be disposed with a bypass piping that bypasses the corresponding use side heat exchanger 26.

Furthermore, as regards each of the use side heat medium flow control device 25, a stepping-motor-driven type that is capable of controlling a flow rate in the passage is preferably used. Alternatively, a two-way valve or a three-way valve whose one end is closed may be used. Alternatively, as regards each use side heat medium flow control device 25, a component, such as an on-off valve, which is capable of opening or closing a two-way passage, may be used while ON and OFF operations are repeated to control an average flow rate.

Furthermore, while each second refrigerant flow switching device 18 has been described as a four-way valve, the device is not limited to this type. The device may be configured such that the refrigerant flows in the same manner using a plurality of two-way flow switching valves or three-way flow switching valves.

While the air-conditioning apparatus 100 according to Embodiment has been described with respect to the case in which the apparatus can perform the cooling and heating mixed operation, the apparatus is not limited to the case. Even in an apparatus that is configured by a single heat exchanger related to heat medium 15 and a single expansion device 16 that are connected to a plurality of parallel use side heat exchangers 26 and heat medium flow control valves 25, and is capable of carrying out only a cooling operation or a heating operation, the same advantages can be obtained.

In addition, it is needless to say that the same holds true for the case in which only a single use side heat exchanger 26 and a single heat medium flow control valve 25 are connected. Moreover, no problem will arise even if the heat exchanger related to heat medium 15 and the expansion device 16 acting in the same manner are arranged in plural numbers. Furthermore, while the case in which the heat medium flow control valves 25 are equipped in the heat medium relay unit 3 has been described, the arrangement is not limited to this case. Each heat medium flow control valve 25 may be disposed in the indoor unit 2. The heat medium relay unit 3 and the indoor unit 2 may be constituted in different housings.

As the heat source side refrigerant, a refrigerant that transits through a supercritical state such as carbon dioxide or a mixed refrigerant of carbon dioxide and diethyl ether can be used; however, other refrigerants that transits through a supercritical state may be used to obtain the same advantageous effects.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

Further, although the heat source side heat exchanger 12 and the use side heat exchangers 26*a* to 26*d* are typically arranged with an air-sending device in which condensing or evaporation is facilitated by the sent air, not limited to the above, a panel heater, using radiation can be used as the use side heat exchangers 26*a* to 26*d* and a water-cooled heat exchanger which transfers heat using water or antifreeze can be used as the heat source side heat exchanger 12. Any component that has a structure that can transfer or remove heat may be used.

Furthermore, while an exemplary description in which there are four use side heat exchangers 26*a* to 26*d* has been given, the number of use side heat exchangers 26 may be determined as appropriate.

Furthermore, while description has been made illustrating a case in which there are two heat exchangers related to heat medium 15, the arrangement is not limited to this case, and as long as it is configured so that cooling and/or heating of the heat medium can be carried out, the number may be any number.

Furthermore, the number of pumps 21 for each heat exchanger related to heat medium is not limited to one. A plurality of pumps having a small capacity may be used in parallel.

Figure 17:
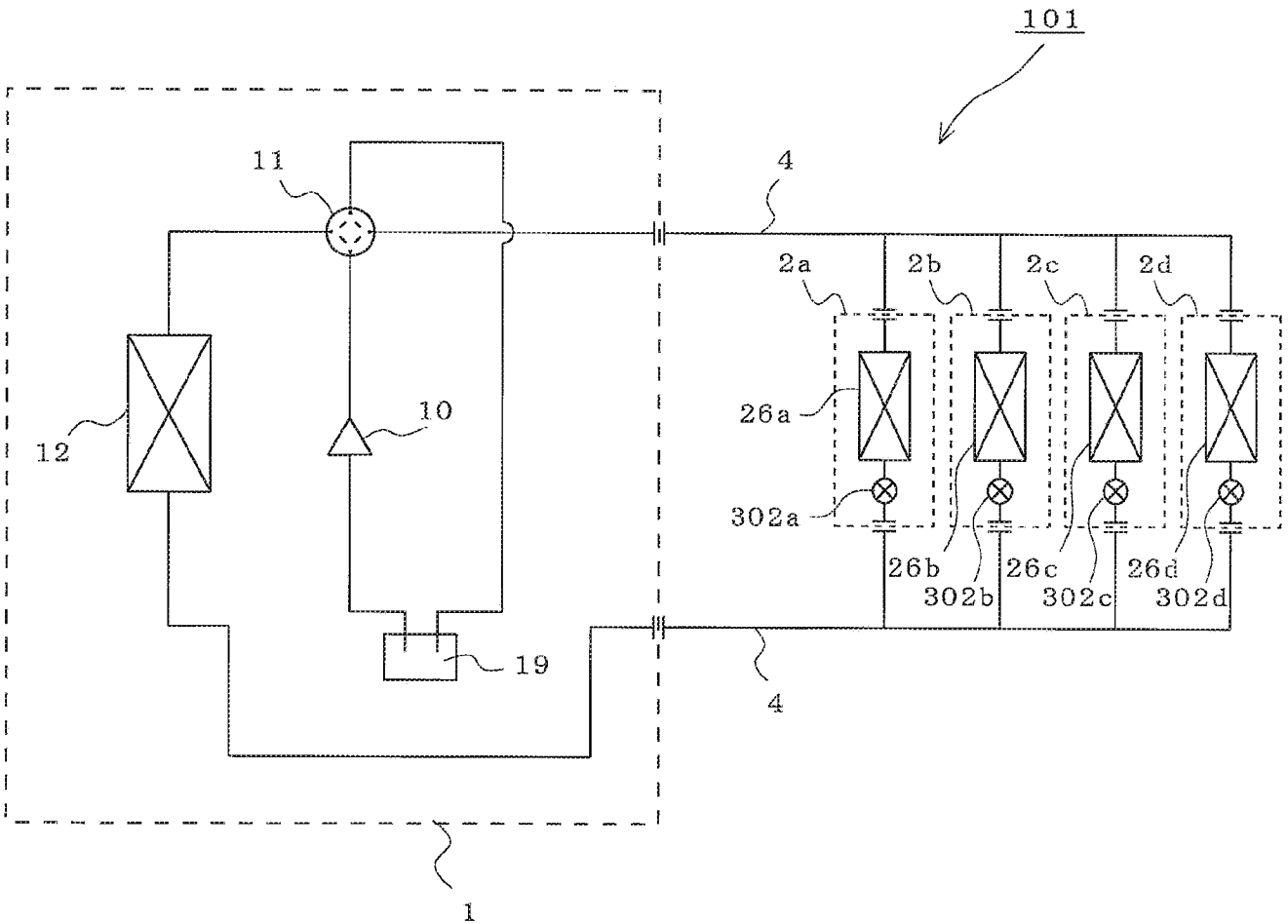
FIG. 17 is a diagram illustrating an example of a direct expansion refrigeration cycle apparatus to which the invention is applicable.

Additionally, the invention can be applied to an arrangement in which a flow dividing device is included in an air-conditioning apparatus 101 of a complete direct expansion type in which the heat source side heat exchanger 12 is connected to the use side heat exchangers 26 through pipings such that the refrigerant is circulated between the heat source side heat exchanger 12 and each of the use side heat exchangers 26, as illustrated in FIG. 17, thus providing the same advantages.

Further, not limited to air-conditioning apparatuses, the same can be applied to refrigeration apparatuses that cool foodstuff and the like by connecting to a showcase or a unit cooler, and the same advantageous effects can be obtained.

Reference Signs List 1, heat source unit (outdoor unit); 2, indoor unit; 2*a*, indoor unit; 2*b*, indoor unit; 2*c*, indoor unit; 2*d*, indoor unit; 3, heat medium relay unit; 4 (4*a*, 4*b*), refrigerant piping; 4*d*, heat-medium-related heat exchanger bypass piping; 5, heat medium piping; 6, outdoor space; 7, indoor space; 8, space, such as space above ceiling, different from outdoor and indoor spaces; 9, structure such as building; 10, compressor; 11, four-way valve (first refrigerant flow switching device); 12, heat source side heat exchanger; 13 (13*a*, 13*b*, 13*c*, 13*d*), check valve; 14, flow dividing device; 15 (15*a*, 15*b*), heat-medium-related heat exchanger; 16 (16*a*, 16*b*), expansion device; 17 (17*a*, 17*b*), on-off device; 18 (18*a*, 18*b*), second refrigerant flow switching device; 19, accumulator; 21 (21*a*, 21*b*), pump; 22 (22*a*, 22*b*, 22*c*, 22*d*), first heat medium flow switching valve; 23 (23*a*, 23*b*, 23*c*, 23*d*) second heat medium flow switching valve; 25 (25*a*, 25*b*, 25*c*, 25*d*), heat medium flow control valve; 26 (26*a*, 26*b*, 26*c*, 26*d*), use side heat exchanger; 31 (31*a*, 31*b*), heat-medium-related-heat-exchanger outlet temperature detecting device; 34 (34*a*, 34*b*, 34*c*, 34*d*), use-side-heat-exchanger outlet temperature detecting device; 35 (35*a*, 35*b*, 35*c*, 35*d*), heat-medium-related-heat-exchanger refrigerant temperature detecting device; 36, heat-medium-related-heat-exchanger refrigerant pressure detecting device; 100, air-conditioning apparatus; A, refrigerant circuit; B, heat medium circuit.

The invention claimed is:

1. A refrigeration cycle apparatus, comprising:

a refrigerant circuit in which a compressor, a first heat exchanger, an expansion device, and a second heat exchanger are connected;

a refrigeration cycle being constituted in which a refrigerant that transits through a supercritical state flows within the refrigerant circuit;

the first heat exchanger being distributed with the refrigerant in a supercritical state and being functioned as a gas cooler, or being distributed with the refrigerant in a subcritical state and being functioned as a condenser;

the second heat exchanger being distributed with the refrigerant in a low-pressure two-phase state and being functioned as an evaporator;

refrigerating machine oil being enclosed within the refrigerant circuit, the refrigerating machine oil having miscibility with the refrigerant at or below a certain temperature and having immiscibility or poor miscibility with the refrigerant above the certain temperature when the refrigerant is in the subcritical state in which a pressure of the refrigerant is lower than a critical pressure of the refrigerant; and a flow dividing device being disposed at any position in a passage between an outlet side of the first heat exchanger and an inlet side of the expansion device, the flow dividing device being configured to divide a flow of the refrigerant into two or more parts, wherein the flow dividing device is disposed in a position where the refrigerant is in a liquid state when the refrigerant is operated in the subcritical state, and is configured such that a direction of the refrigerant flowing into the flow dividing device is substantially in a horizontal direction or substantially in a vertically upward direction.

2. The refrigeration cycle apparatus of claim 1, wherein a direction of the refrigerant flowing into the flow dividing device is substantially in the horizontal direction, and a direction of the refrigerant flowing out of the flow dividing device is substantially in the horizontal direction and is substantially perpendicular to the flow direction of the refrigerant flowing into the flow dividing device.

3. The refrigeration cycle apparatus of claim 1, wherein a direction of the refrigerant flowing into the flow dividing device is substantially in the horizontal direction, and a direction of the refrigerant flowing out of the flow dividing device is substantially in the horizontal direction and is substantially parallel to the flow direction of the refrigerant flowing into the flow dividing device.

4. The refrigeration cycle apparatus of claim 1, wherein a direction of the refrigerant flowing into the flow dividing device is substantially in the vertically upward direction, and a direction of the refrigerant flowing out of the flow dividing device is substantially in the horizontal direction and is substantially perpendicular to the flow direction of the refrigerant flowing into the flow dividing device.

5. The refrigeration cycle apparatus of claim 1, wherein a direction of the refrigerant flowing into the flow dividing device is substantially in the vertically upward direction, and a direction of the refrigerant flowing out of the flow dividing device is substantially in the vertically upward direction and is substantially parallel to the flow direction of the refrigerant flowing into the flow dividing device.

6. The refrigeration cycle apparatus of claim 1, wherein a temperature at the boundary between immiscibility or poor miscibility and miscibility of the refrigerating machine oil, ranges from −10 degrees C. to 15 degrees C.

7. The refrigeration cycle apparatus of claim 1, further comprising a first refrigerant flow switching device in a passage on an outlet side of the compressor, wherein a switching of the first refrigerant flow switching device allows switching between a cooling operation in which a heat source side heat exchanger disposed in an outdoor location or a machine room is allowed to function as the first heat exchanger and a heating operation in which the heat source side heat exchanger is allowed to function as the second heat exchanger.

8. The refrigeration cycle apparatus of claim 1, wherein air is allowed to flow around either one of the first heat exchanger and the second heat exchanger such that the heat exchanger is used as a heat source side heat exchanger disposed in an outdoor location or a machine room and air is allowed to flow around the other one of the first heat exchanger and the second heat exchanger such that the heat exchanger is used as a use side heat exchanger, and the use side heat exchanger includes a plurality of heat exchangers, and the apparatus further includes a plurality of indoor units which house the plurality of use side heat exchangers, respectively, and which are arranged at positions in each of which a conditioned space is enabled to be air-conditioned.

9. The refrigeration cycle apparatus of claim 1, wherein the refrigerant is carbon dioxide.

* * * * *